US012768068B2

(12) United States Patent
Huang et al.

(10) Patent No.: US 12,768,068 B2
(45) Date of Patent: Oct. 20, 2026

(54) SURFACE COLORING METHOD OF MAGNESIUM ALLOY ARTICLE AND MAGNESIUM ALLOY ARTICLE WITH COLORED SURFACE

(71) Applicant: CATCHER TECHNOLOGY CO., LTD., Tainan City (TW)

(72) Inventors: Yun-Kai Huang, Tainan City (TW); Zih-Tong Deng, Tainan City (TW)

(73) Assignee: CATCHER TECHNOLOGY CO., LTD., Tainan City (TW)

( * ) Notice: Subject to any disclaimer, the term of this patent is extended or adjusted under 35 U.S.C. 154(b) by 276 days.

(21) Appl. No.: 18/650,278

(22) Filed: Apr. 30, 2024

(65) Prior Publication Data

US 2024/0368799 A1 Nov. 7, 2024

(30) Foreign Application Priority Data

May 2, 2023 (TW) ..... 112116232

(51) Int. Cl.
*C25D 11/30* (2006.01)
*H10P 50/60* (2026.01)

(52) U.S. Cl.
CPC ..... *C25D 11/30* (2013.01)

(58) Field of Classification Search
None
See application file for complete search history.

(56) References Cited

U.S. PATENT DOCUMENTS

| | | | | |
|---|---|---|---|---|
| 9,359,686 | B1 * | 6/2016 | Curran | C22F 1/057 |
| 11,248,281 | B2 * | 2/2022 | Seki | C25D 11/10 |
| 2013/0248373 | A1 * | 9/2013 | Shen | C25D 11/16 205/120 |
| 2018/0002825 | A1 * | 1/2018 | Balaraju | C25D 11/246 |
| 2019/0256954 | A1 * | 8/2019 | Bauger | C22F 1/047 |
| 2021/0096604 | A1 * | 4/2021 | Curran | G02B 5/223 |
| 2022/0400569 | A1 * | 12/2022 | Lee | C23F 1/20 |

FOREIGN PATENT DOCUMENTS

| | | | |
|---|---|---|---|
| CN | 104099655 | A | 10/2014 |
| TW | 200528584 | A | 9/2005 |
| TW | 201534487 | A | 9/2015 |
| TW | 202212640 | A | 4/2022 |

* cited by examiner

*Primary Examiner* — Shamim Ahmed
(74) *Attorney, Agent, or Firm* — Li & Cai Intellectual Property (USA) Office

(57) ABSTRACT

A surface coloring method of a magnesium alloy article includes: performing an anodizing treatment on the magnesium alloy article to form an anodized layer having a plurality of pores on an outer surface of the magnesium alloy article; performing an etching treatment on the anodized layer to form a plurality of pits on a surface of the anodized layer that is distant from the magnesium alloy article, in which each of the plurality of pits is in spatial communication with at least one of the plurality of pores; and performing a sealing treatment on the anodized layer after the etching treatment, so that a sealing layer is formed to seal the plurality of pores on the anodized layer. By using the surface coloring method, a surface-colored magnesium alloy article is also provided.

8 Claims, 6 Drawing Sheets

SURFACE COLORING METHOD OF MAGNESIUM ALLOY ARTICLE AND MAGNESIUM ALLOY ARTICLE WITH COLORED SURFACE

CROSS-REFERENCE TO RELATED PATENT APPLICATION

This application claims the benefit of priority to Taiwan Patent Application No. 112116232, filed on May 2, 2023. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a surface coloring method of a light metal article, and more particularly to a surface coloring method of a magnesium alloy article and a magnesium alloy article with a colored surface that is obtained by said surface coloring method.

BACKGROUND OF THE DISCLOSURE

The structure of portable electronic devices currently available on the market is mainly developed toward being lighter, thinner, shorter, and smaller. Due to having excellent mechanical properties and a light weight, magnesium alloy has become a popular material for being used to make housings or other mechanical parts of the portable electronic devices.

In order to meet the appearance diversity and functionality of a product, articles made of the magnesium alloy are usually surface treated. For example, anodizing is performed for forming a layer of anodized film, so as to prevent the magnesium alloy from being directly exposed to the air, decorate the surface of the magnesium alloy, and improve the wear resistance and corrosion resistance of the magnesium alloy. Moreover, the anodized film is porous, and can absorb dyes to change the appearance color of the product. However, pores formed by a typical anodizing treatment are not evenly distributed, thereby resulting in uneven dyeing. In addition, a porous structure formed by the typical anodizing treatment does not allow for effective dye penetration, such that an issue of insufficient dyeing depth may occur.

SUMMARY OF THE DISCLOSURE

In response to the above-referenced technical inadequacies, the present disclosure provides a surface coloring method of a magnesium alloy article and a magnesium alloy article with a colored surface that is obtained by the surface coloring method.

The concept of the present disclosure is to first form an anodized layer having a plurality of regularly arranged and uniform pores on an outer surface of the magnesium alloy article through an anodizing treatment. Then, an etching treatment is incorporated to form a plurality of pits on a surface of the anodized layer that is away from the magnesium alloy article. Moreover, each pit is connected to at least one of the pores, so as to improve a light interference coloring effect and a dye-dyeing effect.

In order to solve the above-mentioned problems, one of the technical aspects adopted by the present disclosure is to provide a surface coloring method of a magnesium alloy article, which includes: providing a magnesium alloy article; performing an anodizing treatment on the magnesium alloy article to form an anodized layer on an outer surface of the magnesium alloy article, in which the anodized layer has a plurality of pores extending toward the outer surface of the magnesium alloy article; performing an etching treatment on the anodized layer to form a plurality of pits on a surface of the anodized layer that is distant from the magnesium alloy article, in which each of the plurality of pits is in spatial communication with at least one of the plurality of pores; and performing a sealing treatment on the anodized layer after the etching treatment. The sealing treatment is to cover the surface of the anodized layer with a sealing layer through electrical hole-sealing, so as to seal the plurality of pores. The sealing layer is formed from a resin composition including an acrylic resin and a solid powder, the solid powder is a powder of a metal, a non-metal, or an oxide of the metal or non-metal.

In one of the possible or preferred embodiments, the anodizing treatment is performed in an electrolytic solution, and the electrolytic solution includes an oxidant, a pH adjusting agent, and a film-forming agent. The oxidant is selected from the group consisting of sodium nitrate, potassium nitrate, potassium permanganate, and potassium dichromate, the pH adjusting agent is selected from the group consisting of sodium hydroxide, potassium hydroxide, lithium hydroxide, and magnesium hydroxide, and the film-forming agent is selected from the group consisting of sodium silicate, aluminum hydroxide, ammonium dihydrogen phosphate, sodium hexametaphosphate, and trisodium phosphate.

In one of the possible or preferred embodiments, the anodizing treatment is a pulse-type anodizing treatment, that includes a voltage gradual-rise stage and a constant-voltage stage subsequent to the voltage gradual-rise stage, an operating voltage of the voltage gradual-rise stage increases from an initial voltage to a target voltage, and an operating voltage of the constant-voltage stage is maintained at the target voltage.

In one of the possible or preferred embodiments, the pulse-type anodizing treatment is performed with the initial voltage being 0 V, and the target voltage ranging from 20 V to 600 V, a pulse frequency ranging from 500 Hz to 2,000 Hz, and a duty cycle ranging from 1% to 50%. A duration of the voltage gradual-rise stage is from 1 minute to 10 minutes, and a duration of the constant-voltage stage is from 5 minutes to 60 minutes, and is more than four times the duration of time of the voltage gradual-rise stage.

In one of the possible or preferred embodiments, the etching treatment is to etch the surface of the anodized layer by using an etching solution, the etching solution is an aqueous solution including nitric acid, sulfuric acid, phosphoric acid, oxalic acid, citric acid and/or salts thereof, and a duration of the etching treatment is from 10 seconds to 1,200 seconds.

In one of the possible or preferred embodiments, the surface coloring method of the present disclosure further includes: filling, between the process of performing the etching treatment and the process of performing the sealing treatment, at least one dye into the plurality of pores of the anodized layer.

In one of the possible or preferred embodiments, a solid content of the resin composition is from 3 wt % to 30 wt %. The electrical hole-sealing is performed at an operating voltage of from 1V to 150 V for 30 seconds to 10 minutes.

In one of the possible or preferred embodiments, the sealing treatment further includes baking the resin composition at a temperature of from 100° C. to 200° C. for 15 minutes to 60 minutes.

In order to solve the above-mentioned problems, another one of the technical aspects adopted by the present disclosure is to provide a surface-colored magnesium alloy article, which includes a magnesium alloy article, an anodized layer, and a sealing layer. The anodized layer is formed on an outer surface of the magnesium alloy article, and has a plurality of pores extending toward the outer surface of the magnesium alloy article. A plurality of pits are formed on a surface of the anodized layer distant from the magnesium alloy article, and each of the plurality of pits is in spatial communication with at least one of the plurality of pores. The sealing layer covers the surface of the anodized layer, so as to seal the plurality of pores.

Therefore, in the surface coloring method of the magnesium alloy article and the magnesium alloy article having the colored surface provided by the present disclosure, by virtue of "performing an anodizing treatment on the magnesium alloy article to form an anodized layer on an outer surface of the magnesium alloy article, in which the anodized layer has a plurality of pores extending toward the outer surface of the magnesium alloy article" and "performing an etching treatment on the anodized layer to form a plurality of pits on a surface of the anodized layer that is distant from the magnesium alloy article, in which each of the plurality of pits is in spatial communication with at least one of the plurality of pores," an intensity of an interference color (the interference color is clear and perceptible) and a dyeing effect of a magnesium alloy surface can be improved, thereby enhancing a decorative property of the magnesium alloy surface and changing an appearance coloring effect of the magnesium alloy surface.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
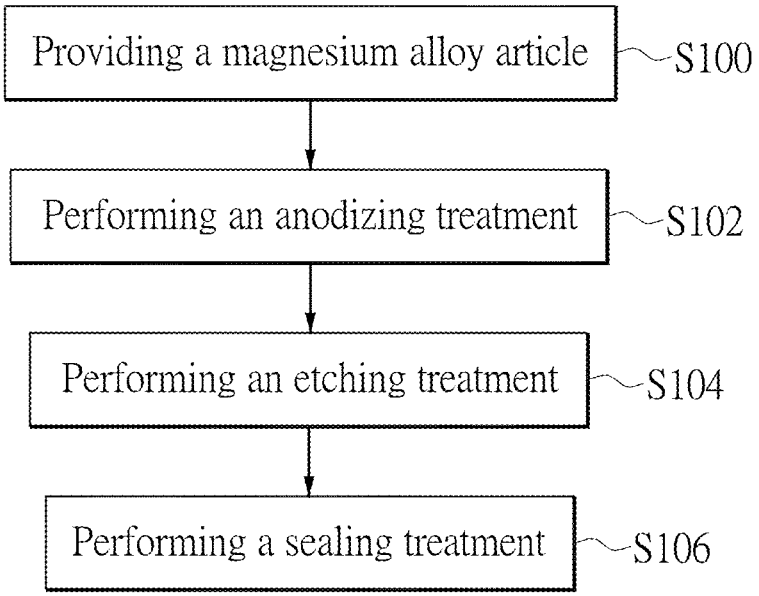
FIG. 1 is a flowchart of a surface coloring method of a magnesium alloy article according to an embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a," "an" and "the" includes plural reference, and the meaning of "in" includes "in" and "on." Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first," "second" or "third" can be used to describe various components, signals or the like, which are for distinguishing one component/signal from another one only, and are not intended to, nor should be construed to impose any substantive limitations on the components, signals or the like.

Unless otherwise stated, the material(s) used in any described embodiment is/are commercially available material(s) or may be prepared by methods known in the art, and the operation(s) or instrument(s) used in any described embodiment is/are conventional operation(s) or instrument (s) generally known in the related art.

In the present disclosure, multiple steps shown in a flowchart are described herein in a specific order. However, this does not indicate or imply that these steps must be executed in the specific order or desired results can only be achieved by execution of all the steps. In practice, it is optional to combine two or more steps into one step, or to divide one step into two or more steps.

The concept of the present disclosure is to first form an anodized layer having a plurality of regularly arranged and uniform pores on an outer surface of a magnesium alloy article through an anodizing treatment. Then, an etching treatment is incorporated to form a plurality of pits on a surface of the anodized layer that is away from the magnesium alloy article. Moreover, each pit is connected to at least one of the pores, so as to improve an intensity of an interference color (the interference color is clear and perceptible) and a dyeing effect.

Figure 4:
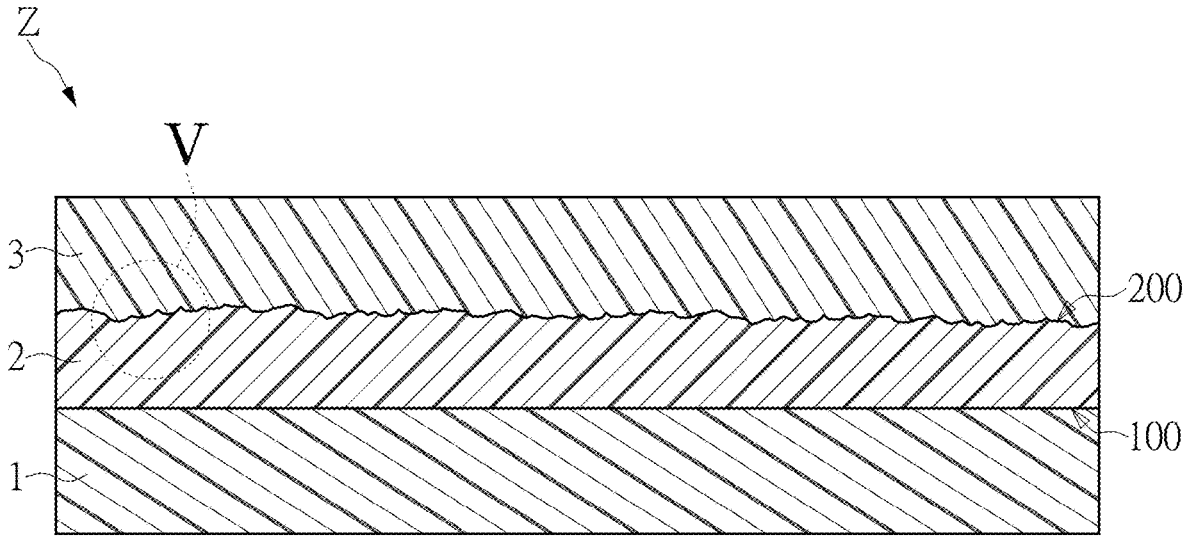
FIG. 4 is a schematic structural view of a magnesium alloy article with a colored surface according to the embodiment of the present disclosure.
Figure 5:
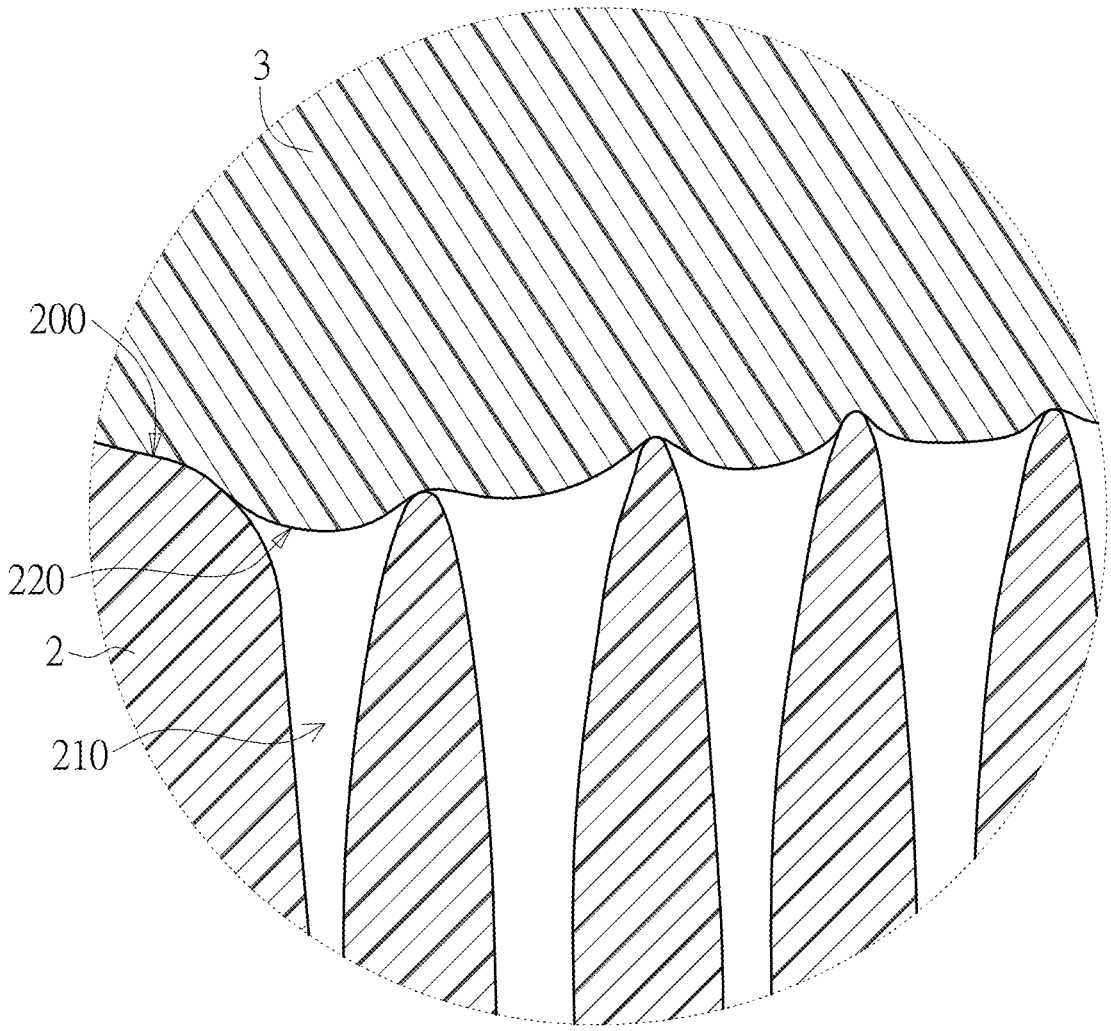
FIG. 5 is a partial schematic enlarged view of part V of FIG. 4, which shows that the magnesium alloy article with the colored surface does not contain a dye according to the embodiment of the present disclosure.

Referring to FIG. 1, an embodiment of the present disclosure provides a surface coloring method of a magnesium alloy article, which mainly includes: providing a magnesium alloy article (step S100); performing an anodizing treatment (step S102); performing an etching treatment (step S104); and performing a sealing treatment (step S106). Referring to FIG. 4 and FIG. 5, the anodizing treatment in step S102 is to form an anodized layer 2 on an outer surface 100 (a surface to be colored) of a magnesium alloy article 1. The anodized layer 2 has a plurality of pores 210 that are regularly arranged and has good uniformity, and the plurality of pores 210 extend toward the outer surface 100 of the magnesium alloy article 1. The etching treatment in step S104 is used to form a plurality of pits 220 on a surface 200 of the anodized layer 2 that is distant from the magnesium alloy article 1, in which each of the plurality of pits 220 is in spatial communication with at least one of the plurality of pores 210. The sealing treatment in step S106 is to cover the surface 200 of the anodized layer 2 with a sealing layer 3, so as to seal the plurality of pores 210.

Each step of the surface coloring method of the magnesium alloy article will be described in detail below.

In step S100, the magnesium alloy article 1 can be shaped by a number of ways (such as casting, extruding, forging, and cutting), so as to have a shape required for practical applications (e.g., sheet-shaped) and be used as a casing, a cover, or a mechanical part. However, such examples are not meant to limit the scope of the present disclosure.

In step S102, the anodizing treatment of the magnesium alloy article 1 is performed in an electrolytic tank (not shown). During the treatment process, the magnesium alloy article 1 is used as an anode, and is electrically connected to a positive electrode of a high-voltage power supply. A cathode (such as a stainless steel electrode) of the electrolytic tank is electrically connected to a negative electrode of the high-voltage power supply. An electrolytic solution used for the anodizing treatment is an alkaline solution, which can include oxidants, pH adjusting agents, and film-forming agents. A content of each component can be reasonably adjusted according to performance requirements of the electrolytic solution. The oxidant can be selected from the group consisting of sodium nitrate, potassium nitrate, potassium permanganate, and potassium dichromate. The pH adjusting agent can be selected from the group consisting of sodium hydroxide, potassium hydroxide, lithium hydroxide, and magnesium hydroxide. The film-forming agent can be selected from the group consisting of sodium silicate, aluminum hydroxide, ammonium dihydrogen phosphate, sodium hexametaphosphate, and trisodium phosphate. However, such examples are not meant to limit the scope of the present disclosure.

Figure 3:
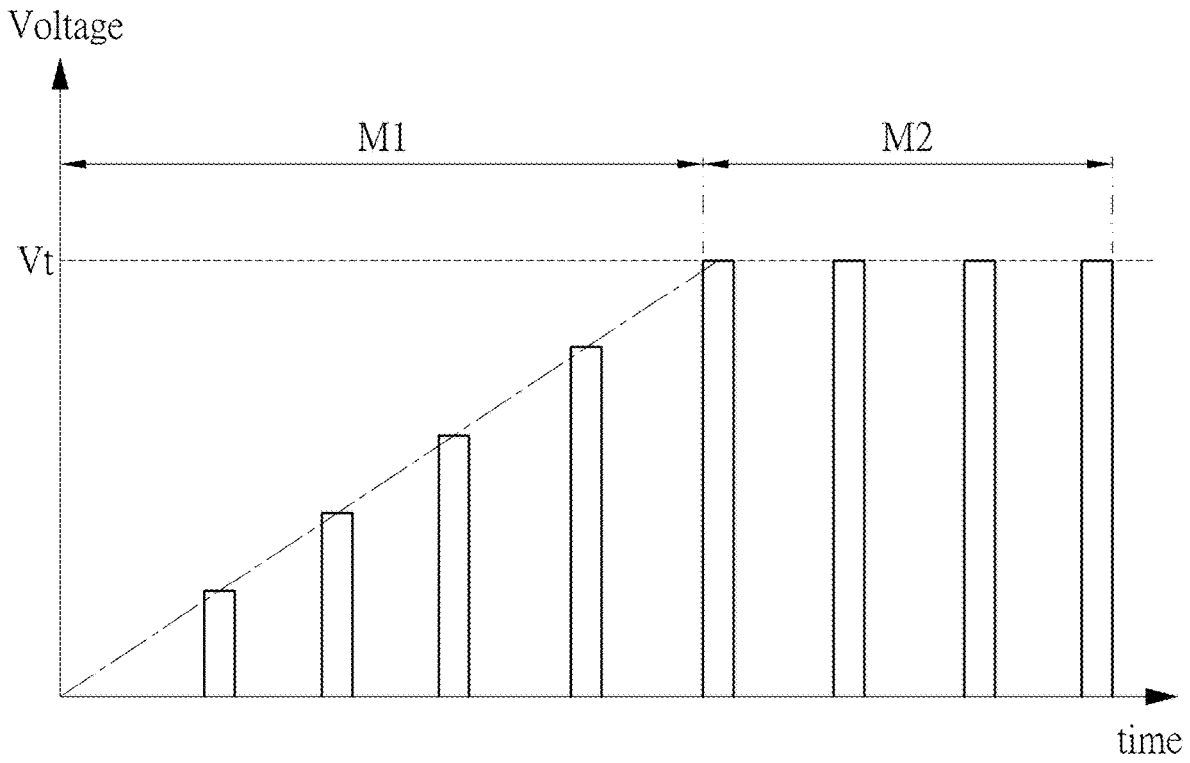
FIG. 3 is a schematic view showing different operational stages of an anodizing treatment used in the surface coloring method of the magnesium alloy article according to the embodiment of the present disclosure.

Referring to FIG. 3, the anodizing treatment is preferably a pulse-type anodizing treatment, which includes a voltage gradual-rise stage M1 followed by a constant-voltage stage M2. An operating voltage of the voltage gradual-rise stage M1 increases from an initial voltage to a target voltage Vt, and an operating voltage of the constant-voltage stage M2 is maintained at the target voltage Vt. In such an operation, the surface smoothness and compactness of the anodized layer 2 can be improved by controlling nucleation, growth, and dissolution rates of magnesium oxide, and the plurality of pores 210 are formed into a configuration that is beneficial to improving light interference and dye absorption.

More specifically, the pulse-type anodizing treatment is performed with the initial voltage being 0 V, the target voltage ranging from 20 V to 600 V, a pulse frequency ranging from 500 Hz to 2,000 Hz, and a duty cycle ranging from 1% to 50%. Furthermore, a duration of the voltage gradual-rise stage M1 is from 1 minute to 10 minutes, and a duration of the constant-voltage stage M2 is from 5 minutes to 60 minutes, and is more than four times the duration of time of the voltage gradual-rise stage M1. It is worth mentioning that, compared to a typical anodizing treatment, the pulse-type anodizing treatment of the present disclosure is advantageous for reducing power consumption and increasing production efficiency.

In the embodiment of the present disclosure, the target voltage Vt of the pulse-type anodizing treatment can be 20 V, 50 V, 100 V, 150 V, 200 V, 250 V, 300 V, 350 V, 400 V, 450 V, 500 V, 550 V, or 600 V. The pulse frequency can be 500 Hz, 600 Hz, 700 Hz, 800 Hz, 900 Hz, 1,000 Hz, 1,100 Hz, 1,200 Hz, 1,300 Hz, 1,400 Hz, 1,500 Hz, 1,600 Hz, 1,700 Hz, 1,800 Hz, 1,900 Hz, or 2,000 Hz. The duty cycle can be 1%, 5%, 10%, 15%, 20%, 25%, 30%, 35%, 40%, 45%, or 50%.

Figure 2:
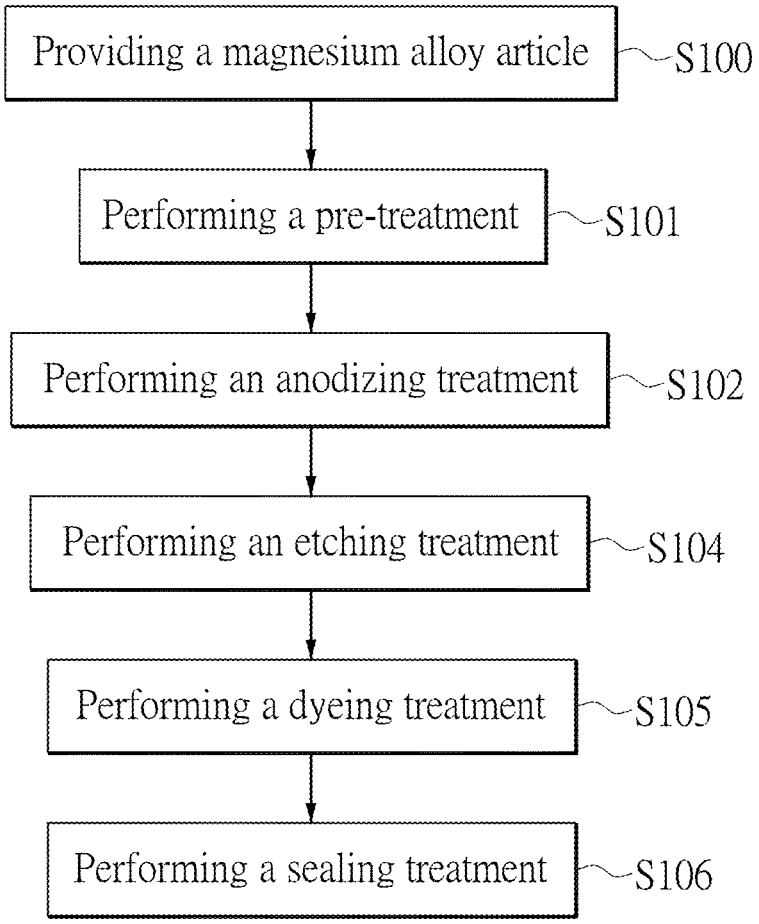
FIG. 2 is another flowchart of the surface coloring method of the magnesium alloy article according to the embodiment of the present disclosure.

Referring to FIG. 2, the surface coloring method of the present disclosure can further include a pre-treatment. That is, the pre-treatment is performed on the magnesium alloy article 1 (step S101) before the anodizing treatment. Accordingly, defects, dirt, or natural oxide films present on the outer surface 100 can be removed, or a special surface effect can be achieved. It should be noted that the means of the pre-treatment varies with different purposes. For example, the means of the pre-treatment can include degreasing, decarbonization, alkaline washing, acid washing, or any combination thereof. Alternatively, the means of the pre-treatment can include polishing, sandblasting, or a combination thereof.

In step S104, the etching treatment is to etch out a multi-level pit structure on the surface 200 of the anodized layer 2 by using an etching solution, and then washing and drying are performed. It should be noted that the multi-level pit structure includes the plurality of pits 220 arranged in different forms, which is beneficial to improving the intensity of the interference color and the dyeing effect. The "different forms" mentioned herein indicates that at least one of a pit diameter, a pit depth, a pit cross-sectional shape, a pit volume, and a pit surface area is significantly different. The etching solution can be an aqueous solution including nitric acid, sulfuric acid, phosphoric acid, oxalic acid, citric acid and/or salt thereof s, and a duration of the etching treatment is from 10 seconds to 1,200 seconds. However, such examples are not meant to limit the scope of the present disclosure.

In step S106, the sealing treatment is to cover the surface 200 of the anodized layer 2 with the sealing layer 3 through electrical hole-sealing, so as to seal the plurality of pores 210, and a part of the sealing layer 3 is filled in the plurality of pores 210. The sealing layer 3 is formed from a resin composition. The resin composition includes an acrylic resin and a solid powder, and can further include colorants if necessary. A solid content of the resin composition is from 3 wt % to 30 wt %, thereby meeting performance requirements such as gloss, hardness, and weather resistance. The solid powder is a powder of a metal, a non-metal, or an oxide of the metal or non-metal. Specific examples of the solid powder include powders of aluminum, gold, silver, and iron, and powders of aluminum oxide, titanium oxide, silicon dioxide, iron oxide, and tin oxide. The electrical hole-sealing is performed at an operating voltage from 1 V to 150 V for 30 seconds to 10 minutes. Afterwards, the resin composition can be cured by baking, and baking conditions include a baking temperature of from 100° C. to 200° C. and a baking time of from 15 minutes to 60 minutes.

Figure 6:
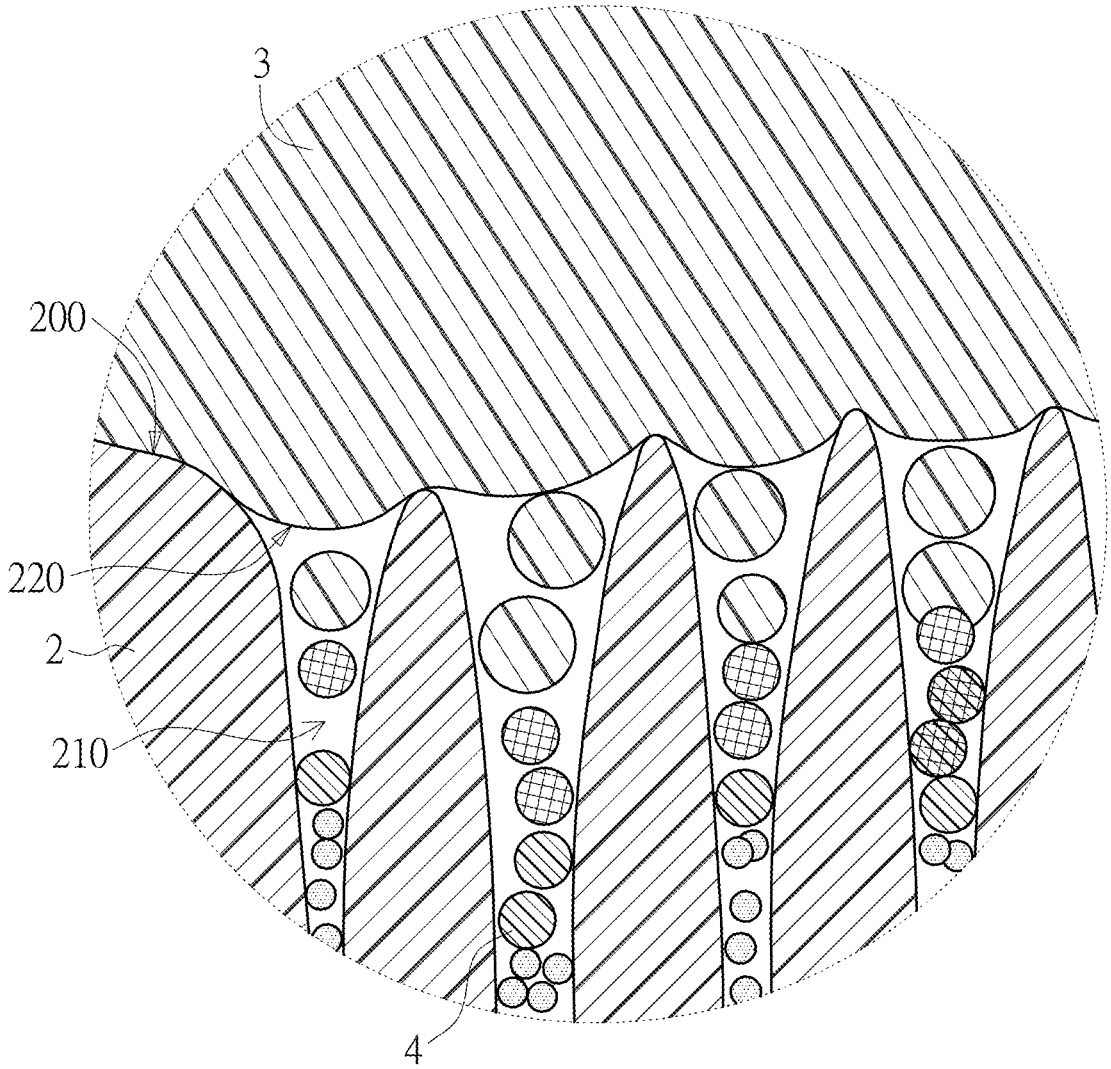
FIG. 6 is a variation view of FIG. 5, which shows that the magnesium alloy article with the colored surface contains the dye according to the embodiment of the present disclosure.

Referring to FIG. 2, which is to be read in conjunction with FIG. 4 and FIG. 6, the surface coloring method of the present disclosure also includes a dyeing treatment (step S105). That is, the magnesium alloy article 1 is dyed before the sealing treatment, so as to change an appearance coloring effect of a magnesium alloy surface.

In the dyeing treatment, a dye 4 is adhered to the magnesium alloy article 1, and at least partially penetrates into the plurality of pores 210 of the anodized layer 2 by immersion dyeing (immersing the magnesium alloy article 1 in the dye 4). If necessary, a water washing process can be used to remove the dye 4 that is not adhered to the anodized layer 2 after the immersion dyeing is completed. The dye 4 used in the dyeing treatment can contain organic pigments or inorganic pigments. It is worth mentioning that, since the arrangement and structure of the plurality of pores 210 are controlled under a predetermined pulse-voltage operation (which includes the voltage gradual-rise stage M1 and the constant-voltage stage M2) in the present disclosure, and the etching treatment is incorporated to form the multi-level pit structure (arranged by the plurality of pits 220 in different forms) above the plurality of pores 210, effects of deeper and more uniform dyeing can be achieved.

The surface coloring method of the present disclosure will be further described with the following examples. However, said examples are disclosed for exemplary purposes only, and are not meant to limit the scope of the present disclosure.

Example 1

An AZ91D magnesium alloy article is immersed in an electrolytic solution having a pH value of 10, and the electrolytic solution includes potassium permanganate as an oxidant, potassium hydroxide as a pH adjusting agent, and sodium silicate as a film-forming agent. With the magnesium alloy article being configured as an anode and stainless steel being configured as a cathode, an anodizing treatment is performed under the conditions of a pulse voltage being 300 V, a pulse frequency being 1,000 Hz, and a duty cycle being 5%. In addition, a duration of a voltage rise stage is 2 minutes, and a duration of a constant-voltage treatment stage is 10 minutes. After being washed with water, the magnesium alloy article is immersed in a phosphoric acid aqueous solution for an etching treatment for 100 seconds. After being washed with water, the magnesium alloy article is immersed in a K080 dye (with its pH value being controlled at 8) produced by Everlight Chemical for a dyeing treatment. With the magnesium alloy article being configured as the anode and the stainless steel being configured as the cathode, the magnesium alloy article is immersed in a resin composition including an acrylic resin and an aluminum oxide powder and having a total solid content of 10% for undergoing an electrical hole-sealing treatment that is performed at a voltage of 20 V for 1 minute. Afterwards, a layer of the resin composition is cured by being baked at 180° C. for 30 minutes. In this way, the magnesium alloy article having a black appearance is obtained.

Example 2

An AZ31B magnesium alloy article is immersed in an electrolytic solution having a pH value of 11, and the electrolytic solution includes sodium nitrate as an oxidant, sodium hydroxide as a pH adjusting agent, and sodium hexametaphosphate as a film-forming agent. With the magnesium alloy article being configured as an anode and stainless steel being configured as an cathode, an anodizing treatment is performed with a pulse voltage being 400 V, a pulse frequency being 1,200 Hz, and a duty cycle being 7%. In addition, a duration of a voltage rise stage is 1 minute, and a duration of a constant-voltage treatment stage is 5 minutes. After being washed with water, the magnesium alloy article is immersed in a phosphoric acid aqueous solution for an etching treatment for 50 seconds. After being washed with water, the magnesium alloy article is immersed in a 503 dye (with its pH value being controlled at 9) produced by Okuno for a dyeing treatment. With the magnesium alloy article being configured as the anode and the stainless steel being configured as the cathode, the magnesium alloy article is immersed in a resin composition including an acrylic resin and a silver powder and having a total solid content of 13% for undergoing an electrical hole-sealing treatment that is performed at a voltage of 30 V for 30 seconds. Afterwards, a layer of the resin composition is cured by being baked at 160° C. for 60 minutes. In this way, the magnesium alloy article having a blue appearance is obtained.

Example 3

An AM60B magnesium alloy article is immersed in an electrolytic solution having a pH value of 12, and the electrolytic solution includes potassium nitrate as an oxidant, lithium hydroxide as a pH adjusting agent, and sodium hexametaphosphate as a film-forming agent. With the magnesium alloy article being configured as an anode and stainless steel being configured as a cathode, an anodizing treatment is performed under the conditions of a pulse voltage being 380 V, a pulse frequency being 800 Hz, and a duty cycle being 10%. In addition, a duration of a voltage rise stage being 5 minutes, and a duration of a constant-voltage treatment stage is 20 minutes. After being washed with water, the magnesium alloy article is immersed in a phosphoric acid aqueous solution for an etching treatment for 30 seconds. After being washed with water, the magnesium alloy article is immersed in a 102 dye (with its pH value being controlled at 10) produced by Okuno for a dyeing treatment. With the magnesium alloy article being configured as the anode and the stainless steel being configured as the cathode, the magnesium alloy article is immersed in a resin composition including an acrylic resin and an iron oxide powder and having a total solid content of 15% for undergoing an electrical hole-sealing treatment that is performed at a voltage of 50 V for 2 minutes. Afterwards, a layer of the resin composition is cured by being bake at 200° C. for 20 minutes. In this way, the magnesium alloy article having a yellow red appearance is obtained.

Referring to FIG. 4 to FIG. 6, a surface-colored magnesium alloy article Z can be obtained by using the surface coloring method of the present disclosure. The surface-colored magnesium alloy article Z includes a magnesium alloy article 1, an anodized layer 2, and a sealing layer 3. The anodized layer 2 is formed on an outer surface 100 of the magnesium alloy article 1 and having a plurality of pores 210 extending toward the outer surface 100 of the magnesium alloy article 1. A plurality of pits 220 are formed on a surface 200 of the anodized layer 2 distant from the magnesium alloy article 1, and each of the plurality of pits 220 is in spatial communication with at least one of the plurality of pores 210. The sealing layer 3 covers the surface 200 of the anodized layer 2 to seal the plurality of pores 210. In embodiments of the present disclosure, a dye 4 (which can be one dye or a combination of dyes) may or may not exist in the plurality of pores 210 for changing the appearance coloring effect of the magnesium alloy surface.

Beneficial Effects of the Embodiments

In conclusion, in the surface coloring method of the magnesium alloy article and the magnesium alloy article having the colored surface provided by the present disclosure, by virtue of "performing an anodizing treatment on the magnesium alloy article to form an anodized layer on an outer surface of the magnesium alloy article, in which the anodized layer has a plurality of pores extending toward the outer surface of the magnesium alloy article" and "performing an etching treatment on the anodized layer to form a plurality of pits on a surface of the anodized layer that is distant from the magnesium alloy article, in which each of the plurality of pits is in spatial communication with at least one of the plurality of pores," an intensity of an interference color (the interference color is clear and perceptible) and a dyeing effect of a magnesium alloy surface can be improved, thereby enhancing a decorative property of the magnesium alloy surface and changing an appearance coloring effect of the magnesium alloy surface.

More specifically, the anodizing treatment used in the surface coloring method of the present disclosure is a pulse-type anodizing treatment, which includes a voltage gradual-rise stage and a constant-voltage stage subsequent to the voltage gradual-rise stage. In such an operation, the surface smoothness and compactness of the anodized layer can be improved by controlling nucleation, growth, and dissolution rates of magnesium oxide, and the pores are formed into a configuration that is beneficial to improving light interference and dye absorption. Furthermore, compared to a typical anodizing treatment, the anodizing treatment of the present disclosure is advantageous for reducing power consumption and increasing production efficiency.

In addition, the arrangement and structure of the pores of the anodized layer are controlled under a predetermined pulse-voltage operation in the present disclosure, and the etching treatment is incorporated to form the multi-level pits structure (arranged by the plurality of pits in different forms) on the plurality of pores, so that effects of deeper and more uniform dyeing can be achieved.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A surface coloring method of a magnesium alloy article, comprising:

providing a magnesium alloy article;

performing an anodizing treatment on the magnesium alloy article to form an anodized layer on an outer surface of the magnesium alloy article, wherein the anodized layer has a plurality of pores extending toward the outer surface of the magnesium alloy article;

performing an etching treatment on the anodized layer to form a plurality of pits on a surface of the anodized layer that is distant from the magnesium alloy article, wherein each of the plurality of pits is in spatial communication with at least one of the plurality of pores; and performing a sealing treatment on the anodized layer after the etching treatment;

wherein the sealing treatment is to cover the surface of the anodized layer with a sealing layer through electrical hole-sealing, so as to seal the plurality of pores, and the sealing layer is formed from a resin composition including an acrylic resin and a solid powder, the solid powder is a powder of a metal, a non-metal, or an oxide of the metal or non-metal.

2. The surface coloring method according to claim 1, wherein the anodizing treatment is performed in an electrolytic solution, and the electrolytic solution includes an oxidant, a pH adjusting agent, and a film-forming agent; wherein the oxidant is selected from the group consisting of sodium nitrate, potassium nitrate, potassium permanganate, and potassium dichromate, the pH adjusting agent is selected from the group consisting of sodium hydroxide, potassium hydroxide, lithium hydroxide, and magnesium hydroxide, and the film-forming agent is selected from the group consisting of sodium silicate, aluminum hydroxide, ammonium dihydrogen phosphate, sodium hexametaphosphate, and trisodium phosphate.

3. The surface coloring method according to claim 1, wherein the anodizing treatment is a pulse-type anodizing treatment that includes a voltage gradual-rise stage and a constant-voltage stage subsequent to the voltage gradual-rise stage, an operating voltage of the voltage gradual-rise stage increases from an initial voltage to a target voltage, and an operating voltage of the constant-voltage stage is maintained at the target voltage.

4. The surface coloring method according to claim 3, wherein the pulse-type anodizing treatment is performed with the initial voltage being 0 V, the target voltage ranges from 20 V to 600 V, a pulse frequency ranges from 500 Hz to 2,000 Hz, and a duty cycle ranges from 1% to 50%; wherein a duration of the voltage gradual-rise stage is from 1 minute to 10 minutes, and a duration of the constant-voltage stage is from 5 minutes to 60 minutes, and is more than four times the duration of the voltage gradual-rise stage.

5. The surface coloring method according to claim 1, wherein the etching treatment is to etch the surface of the anodized layer by using an etching solution, the etching solution is an aqueous solution including nitric acid, sulfuric acid, phosphoric acid, oxalic acid, citric acid, and/or salts thereof, and a duration of the etching treatment is from 10 seconds to 1,200 seconds.

6. The surface coloring method according to claim 1, further comprising: filling, between the process of performing the etching treatment and the process of performing the sealing treatment, at least one dye into the plurality of pores of the anodized layer.

7. The surface coloring method according to claim 1, wherein a solid content of the resin composition is from 3 wt % to 30 wt %; wherein the electrical hole-sealing is performed at an operating voltage from 1 V to 150 V for 30 seconds to 10 minutes.

8. The surface coloring method according to claim 1, wherein the sealing treatment further includes baking the resin composition at a temperature of from 100° C. to 200° C. for 15 minutes to 60 minutes.

* * * * *